US005398488A

United States Patent [19]

Brown

[11] Patent Number: 5,398,488

[45] Date of Patent: Mar. 21, 1995

[54] SAFETY STIRRUP

[75] Inventor: Roy L. Brown, Nevada, Mo.

[73] Assignee: Ortho-Flex Saddle Company, Inc., Nevada, Mo.

[21] Appl. No.: 143,636

[22] Filed: Nov. 1, 1993

[51] Int. Cl.[6] ..... B68C 3/00

[52] U.S. Cl. ..... 54/47

[58] Field of Search ..... 54/47, 49

[56] References Cited

U.S. PATENT DOCUMENTS

| | | | |
|---|---|---|---|
| 396,179 | 1/1889 | Taylor | 54/47 |
| 444,298 | 1/1891 | Kerns | 54/47 |
| 3,905,179 | 9/1975 | Bischeltsrieder | 54/47 |

FOREIGN PATENT DOCUMENTS

| | | | |
|---|---|---|---|
| 14186 | of 1907 | United Kingdom | 54/47 |

OTHER PUBLICATIONS

Dover Saddlery 1993–1994 Catalog, p. 46.

*Primary Examiner*—Robert P. Swiatek

*Attorney, Agent, or Firm*—Hovey, Williams, Timmons & Collins

[57] ABSTRACT

An improved safety stirrup (10) which prevents significant rearward shifting of the stirrup body (24), thereby reducing the possibility that a rider's foot (F) can pass completely through the stirrup body (24) and present a safety hazard. The safety stirrup body (24) includes an upper suspension shaft (26) having a pair of spaced, descending stirrup legs (28, 30) and a lowermost footpad (32); the shaft (26) is pivotally received within a looped stirrup strap (14). Significant rearward pivoting of the body (24) is prevented by provision of a plurality of upright, elongated, forwardly canted cam members (38–42) extending upwardly from the shaft (26). The cam members (38–42) are co-operable with the looped strap (14) for inhibiting rearward pivoting of the body (24).

7 Claims, 2 Drawing Sheets

SAFETY STIRRUP

BACKGROUND OF THE INVENTION

1. Field of the Invention

The present invention is broadly concerned with an improved stirrup construction which is designed to inhibit rearward rotation of the stirrup to thus prevent inadvertent passage of a rider's foot completely through the stirrup and consequent injury to the rider. More particularly, the invention pertains to a safety stirrup having an upper, forwardly canted cam arrangement which is co-operable with the stirrup strap for preventing undue rearward rotation of the stirrup.

2. Description of the Prior Art

A common accident among horsemen results when the rider's foot passes forwardly through a stirrup, and can lead to an extreme danger to the rider of being dragged by the horse if the rider falls from the saddle while his foot is so entangled with the stirrup. This type of mishap is especially common with western-type saddles making use of stirrups having suspension shafts or tubes pivotally supported by small, looped leather straps which buckle around these shafts. Such stirrup arrangements allow the stirrup bodies to swing front-to-rear in an arc sometimes exceeding 180 degrees. This relatively unrestricted rearward stirrup rotation is a prime cause of accidents where the rider's foot passes completely through a stirrup.

A number of safety stirrups have been proposed in the past in an attempt to provide stirrup assemblies which prevent or at least ameliorate rider accidents. For example, U.S. Pat. No. 4,969,316 describes a cantilever stirrup designed to give way if a rider falls, thus preventing entanglement between the stirrup and the rider's foot. However, this patent does not provide any means for preventing or limiting rearward pivoting of the stirrup itself.

U.S. Pat. Nos. 367,696, 1,074,481, 215,942, 23,572, 107,448 and 4,281,503 describe other types of specialized stirrup constructions seeking to provide enhanced rider safety. Here again though, these patents do not address the problem of unrestricted, front-to-rear pivoting of stirrups.

SUMMARY OF THE INVENTION

The present invention overcomes the problems outlined above and provides an improved safety stirrup which includes structure for preventing significant rearward pivoting of the stirrup body, thereby reducing the risk of rider accident.

More particularly, the safety stirrup of the invention is adapted to be suspended from a looped stirrup strap of conventional construction and includes a stirrup body having an upper, elongated suspension pivot shaft with a pair of descending legs secured in spaced relationship to the shaft, and a lower footpad extending between and coupled with the stirrup legs. The legs and footpad are oriented for defining an open rearward foot entrance end and an opposed, open forward end, as well as a foot-receiving region between the ends and above the footpad. The upper shaft is configured for receipt within a looped stirrup strap for pivoting of the stirrup body about the longitudinal axis of the shaft. Finally, means is provided in association with the shaft for preventing significant rearward pivoting of the stirrup body, while also allowing significant forward pivoting thereof.

In preferred forms, significant rearward pivoting of the stirrup is retarded by means of cam structure operably coupled with the upper shaft and cooperable with the supporting looped stirrup strap. Advantageously, this cam structure includes at least one upright, elongated cam body extending upwardly from the shaft and oriented at a forward angle; in practice, a plurality of laterally spaced cam bodies each having uppermost rounded surfaces are employed.

The safety stirrups of the invention are significantly inhibited from pivoting rearwardly (i.e., toward the horse's rear), but forward pivoting thereof is not materially reduced. In this fashion, the mounting and riding experience is very normal, but undue rearward pivoting of the stirrups is prevented to enhance safety.

DETAILED DESCRIPTION OF THE PREFERRED EMBODIMENTS

Figures 1, 2:
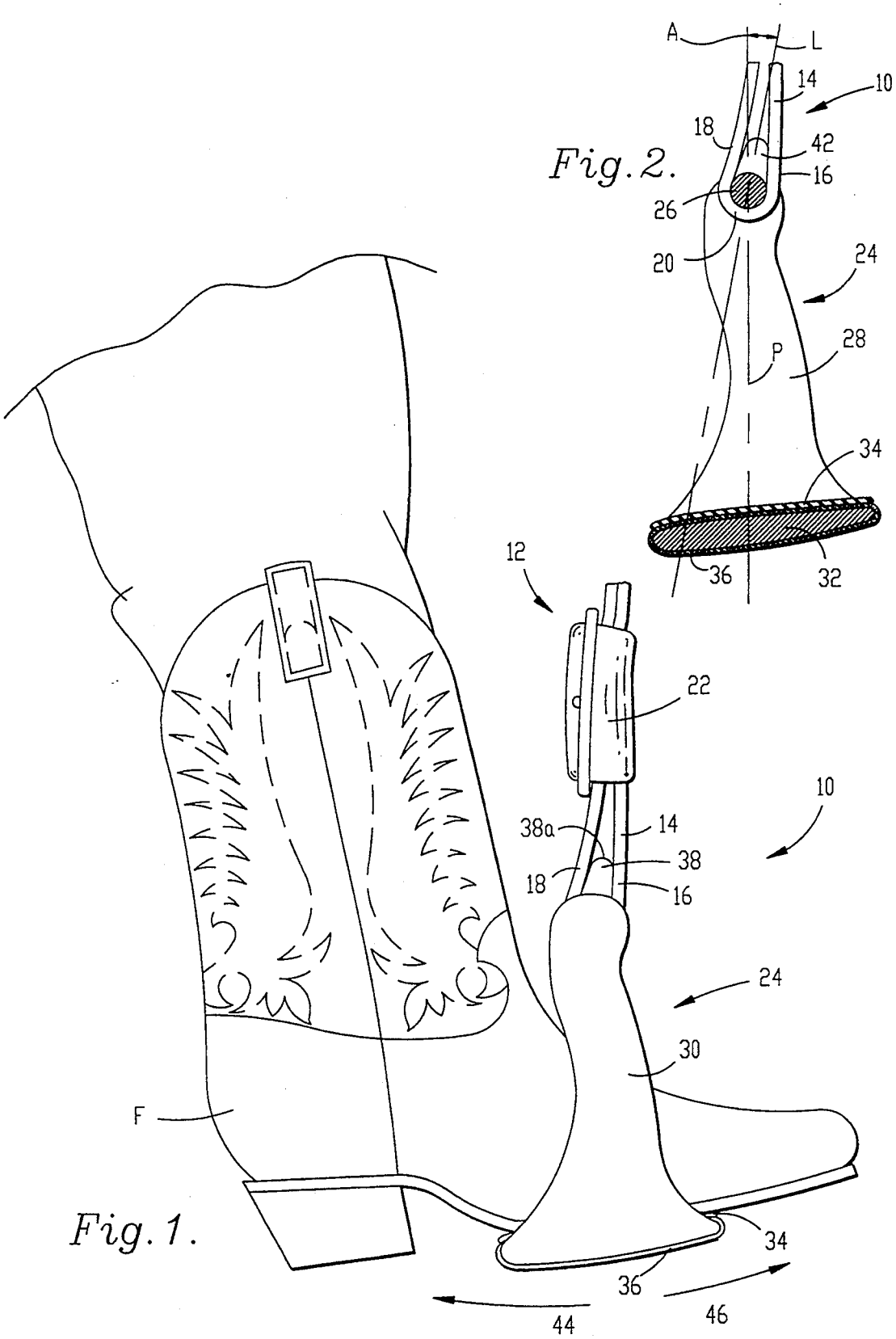
FIG. 1 is a side elevational view of a safety stirrup in accordance with the invention, shown with a rider's foot within the stirrup body.
FIG. 2 is a vertical sectional view of the preferred safety stirrup, shown at rest and illustrating the orientation of the upper cam structure relative to a vertical plane passing through the central axis of the upper suspension shaft of the stirrup.

Turning now to the drawings, and particularly FIGS. 2–5, a safety stirrup 10 is illustrated which is adapted to the suspended form of a conventional looped stirrup strap 12. The strap 12 is in the form of a continuous leather strap element 14 presenting opposed, forward and rearward upright strap segments 16, 18 as well as lowermost bight segment 20. The segments 14, 16 are connected above bight segment 20 by means of conventional buckle 22.

The stirrup 10 includes a metallic stirrup body 24 having an upper, elongated suspension shaft 26 as well as a pair of endmost, depending, outwardly curved, inner and outer legs 28, 30. A footpad 32 extends between and inner connects the legs 28–30 adjacent the lower ends thereof as shown. A non-slip friction pad 34 is affixed to the upper surface of footpad 32 by means of leather connection strap 36. In practice, the friction pad 34 is formed of synthetic resin and presents a knurled or textured uppermost surface; the pad 34 is then stitched to the upper stretch of strap 36, with the opposed ends of the strap 36 being wrapped around footpad 32. This strap is wet-fitted around the footpad 32 with the ends thereof being stitched together or otherwise adhered to the lower surface of footpad 32.

Figure 5:
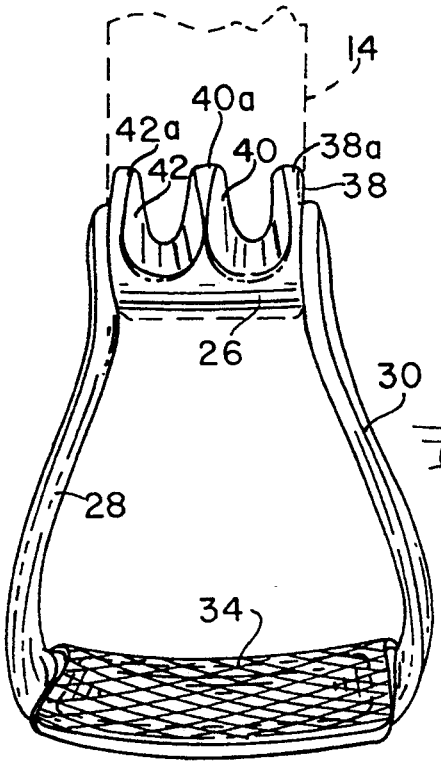
FIG. 5 is a rear elevational view of the stirrup body illustrating the rearward entrance end thereof.
Figure 4:
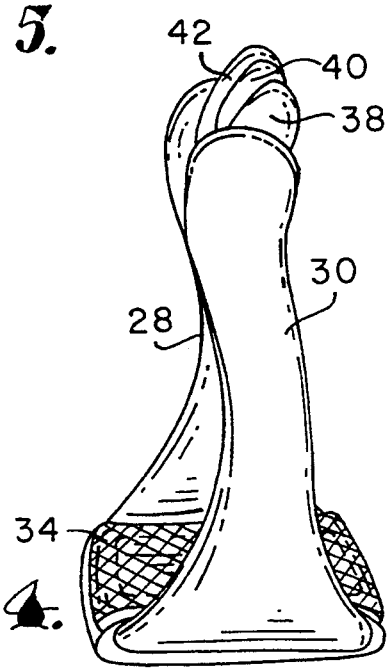
FIG. 4 is a side view of the stirrup body depicted in FIG. 3.
Figure 3:
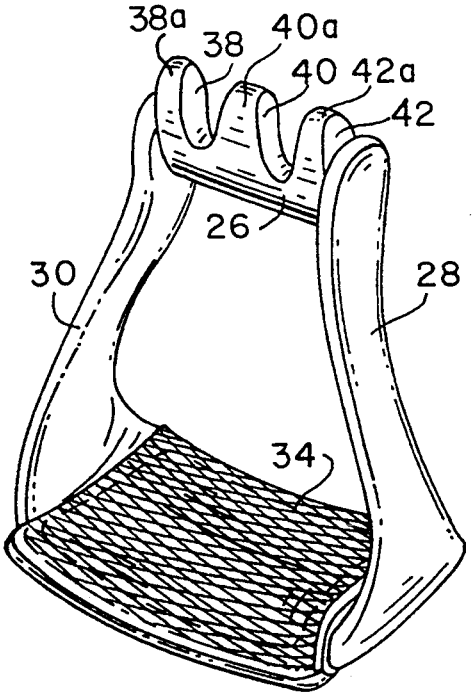
FIG. 3 is a perspective view of the preferred stirrup body of the invention, illustrating the forward open end thereof and the forwardly canted cam structure.

The body 24 also includes a plurality of elongated, upwardly extending, forwardly canted cam members 38, 40 and 42 each having a rounded uppermost end **38*a*, 40*a* and 42*a*. As best seen in FIGS. 3 and 5, the forward faces of the individual cam members 38–42 are smooth, uninterrupted and substantially planar; the rearward faces, however, are bevelled as illustrated in FIG. 5**.

In practice, the stirrup body 24 is preferably fabricated as an integral metallic unit formed from a lightweight metal such as aluminum-magnesium alloy.

The use of stirrup body 24 is best illustrated in FIGS. 1–2. That is to say, the looped strap element 14 is passed around upper shaft 26 and connected via buckle 22. In such orientation, the bight segment 20 comes into conforming relationship with shaft 26, thereby permitting the latter to pivot and suspending the entire shaft body from the strap element 14.

The normal use position of the stirrup 10 is shown in FIG. 2, i.e., the position assumed by the body 24 when a rider's foot is normally within the stirrup body. It will be observed that the footpad 34 is oriented at a slight upward angle in this normal use position. Furthermore, it will be seen that the longitudinal axes L of the respective cam members 38–42 lie at a forward angle A relative to a vertical plane P passing through the central axis of the shaft 26. This angle A can be up to about 40 degrees, but is more preferably to about 10–30degrees. Finally, in this rest position the forward faces of the cam members 38–42 are in contact with the strap segment 16 as shown.

Referring to FIG. 1, a rider's foot F is shown within the confines of stirrup body 24. In such use, the force exerted on the body 24 levers the body forwardly to the FIGS. 1–2 position, and the cam bodies 38–42 prevent significant rearward pivoting of the stirrup body 24 in the direction of arrow 44. This results from the fact that, as the body 24 moves in the direction of arrow 44, the cam members 38–42 encounter increasing resistance owing to the presence of the strap segment 16. It has been found that the body 24 is essentially completely prevented from rearward pivoting to an angle where the rider's foot F can pass completely through the stirrup body. On the other hand, it will be readily apparent that forward pivoting of the body 24 in the direction of arrow 46 is not significantly hampered, at least through an arc sufficient to facilitate mounting of the horse.

I claim:

1. A safety stirrup adapted to be suspended from a looped stirrup strap and comprising:

a stirrup body presenting an upper, elongated suspension shaft, a pair of spaced descending legs secured to said shaft, and a lower footpad extending between and coupled with said legs in spaced relationship to said shaft, said legs and footpad being oriented for defining an open rearward foot entrance end, an opposed open forward end, and a foot-receiving region between said ends and above said footpad, said shaft being configured for receipt within said looped stirrup strap for pivoting of the stirrup body about the longitudinal axis of said shaft; and means associated with said shaft for preventing significant rearward pivoting of said stirrup body, said pivoting-preventing means comprising cam structure operably coupled with said shaft and co-operable with said looped stirrup strap for preventing said significant rearward pivoting, said cam structure comprising at least one upright, elongated cam body extending upwardly from said shaft, with the longitudinal axis of said at least one cam body being oriented at an angle relative to a vertical plane passing through the central axis of said shaft when said stirrup body is suspended from said looped stirrup strap and is in the normal use position thereof.

2. The safety stirrup of claim 1, said forward angle being from about 10–30 degrees relative to said vertical plane.

3. The safety stirrup of claim 1, said cam structure comprising a plurality of upright, laterally spaced apart cam bodies.

4. The safety stirrup of claim 1, said at least one cam body presenting a rounded uppermost surface for engaging said looped stirrup strap.

5. The safety stirrup of claim 1, said at least one cam body being integral with said shaft.

6. The safety stirrup of claim 1, said longitudinal axis of said at least one cam body being oriented at a forward angle relative to said vertical plane.

7. A safety stirrup adapted to be suspended from a looped stirrup strap and comprising:

a stirrup body presenting an upper, elongated suspension shaft, a pair of spaced descending legs secured to said shaft, and a lower footpad extending between and coupled with said legs in spaced relationship to said shaft, said legs and footpad being oriented for defining an open rearward foot entrance end, an opposed open forward end, and a foot-receiving region between said ends and above said footpad, said shaft being configured for receipt within said looped stirrup strap for pivoting of the stirrup body about the longitudinal axis of said shaft; and means associated with said shaft for preventing significant rearward pivoting of said stirrup body, said pivoting -preventing means comprising cam structure operably coupled with said shaft and co-operable with said looped stirrup strap for preventing said significant rearward pivoting, said cam structure comprising a plurality of upright, laterally spaced apart cam bodies.

* * * * *